US005794412A

United States Patent [19]

Ronconi

[11] Patent Number: 5,794,412

[45] Date of Patent: Aug. 18, 1998

[54] METHOD OF FOLDING A PORTION OF DIELECTRIC SHEET MATERIAL

[75] Inventor: Giuseppe Ronconi, Ronta, Italy

[73] Assignee: CO.ME.SCA. Costruzioni Meccaniche Scarperia S.r.l., Viale Kennedy, Italy

[21] Appl. No.: 816,312

[22] Filed: Mar. 13, 1997

[30] Foreign Application Priority Data

Mar. 15, 1996 [IT] Italy ..... BO96A0144

[51] Int. Cl.[6] ..... B65B 11/00

[52] U.S. Cl. ..... 53/466; 53/480; 53/482; 53/141; 156/273.1; 156/379.6

[58] Field of Search ..... 53/466, 480, 482, 53/111 R, 141, 375.4, 374.7; 156/273.1, 379.6, 379.9

[56] References Cited

U.S. PATENT DOCUMENTS

| | | | |
|---|---|---|---|
| 3,657,857 | 4/1972 | De Woskin et al. | 53/453 |
| 3,892,614 | 7/1975 | Levy | 156/273.1 |
| 4,749,348 | 6/1988 | Klasse et al. | 53/111 R |
| 4,945,709 | 8/1990 | Cerf | 53/550 |
| 5,199,246 | 4/1993 | Rodrigo | 53/141 |
| 5,536,354 | 7/1996 | Akuike et al. | 156/273.1 |

FOREIGN PATENT DOCUMENTS

| | | | |
|---|---|---|---|
| 1104679 | 4/1961 | Germany | 156/273.1 |
| 2160843 | 1/1986 | United Kingdom | 53/466 |

*Primary Examiner*—James F. Coan
*Assistant Examiner*—Gene L. Kim
*Attorney, Agent, or Firm*—Klauber & Jackson

[57] ABSTRACT

A method of folding a portion of dielectric sheet material, the method including the steps of mating with a support a sheet including the portion for folding; folding the portion onto an outer surface of the support; and generating an electrostatic force of attraction between the portion and the outer surface of the support.

8 Claims, 4 Drawing Sheets

METHOD OF FOLDING A PORTION OF DIELECTRIC SHEET MATERIAL

BACKGROUND OF THE INVENTION

The present invention relates to a method of folding a portion of dielectric sheet material.

The present invention is particularly advantageous for use on overwrapping machines, particularly cellophaning machines for substantially parallelepiped packets, to which the following description refers purely by way of example.

On cellophaning machines of the above type, a sheet of transparent synthetic heat-seal material, normally polypropylene, is folded into a U about a respective product comprising a substantially parallelepiped packet, so that two opposite portions of the sheet project beyond the product; the two portions are then folded one on top of the other and onto an outer surface of the product to form a tubular wrapping; and the wrapping is stabilized by heat-sealing the two portions together.

On known cellophaning machines, at least a first of said portions is normally folded onto an outer surface of the product by means of a folding element, which moves back and forth with respect to the product to fold the first portion squarely, and is then withdrawn, by moving either the folding element itself or the product, to free the folded first portion and enable the second portion to be folded onto the first, normally by means of a fixed folding element.

On known cellophaning machines of the above type, folding the first portion poses serious difficulties, due to the tendency of the folding element, as it withdraws, to partly draw back the folded first portion. Moreover, the first portion must normally be retained by external elements during the time interval between being folded and heat-sealed.

SUMMARY OF THE INVENTION

It is an object of the present invention to provide a method designed to eliminate the aforementioned drawbacks.

According to the present invention, there is provided a method of folding a portion of dielectric sheet material, the method comprising the steps of mating a sheet comprising said portion with a support, and folding the portion onto an outer surface of said support; and being characterized by also comprising the step of generating an electrostatic force of attraction between said portion and said outer surface.

Said force is preferably generated by forming a first given distribution of electric charges on an inner surface of said portion, and a second distribution of charges of opposite sign on said outer surface.

According to a preferred embodiment of the above method, said first distribution of charges is formed by polarizing said portion by means of an electric field prior to said step of folding the portion; said second distribution of charges being formed by induction by said first distribution of charges as said portion is folded.

According to a further preferred embodiment of the above method, both said distributions of charges are formed simultaneously by polarization by means of an electric field; and said folding step is preferably performed by means of a folding element forming one of the plates of a capacitor generating said electric field.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1A:
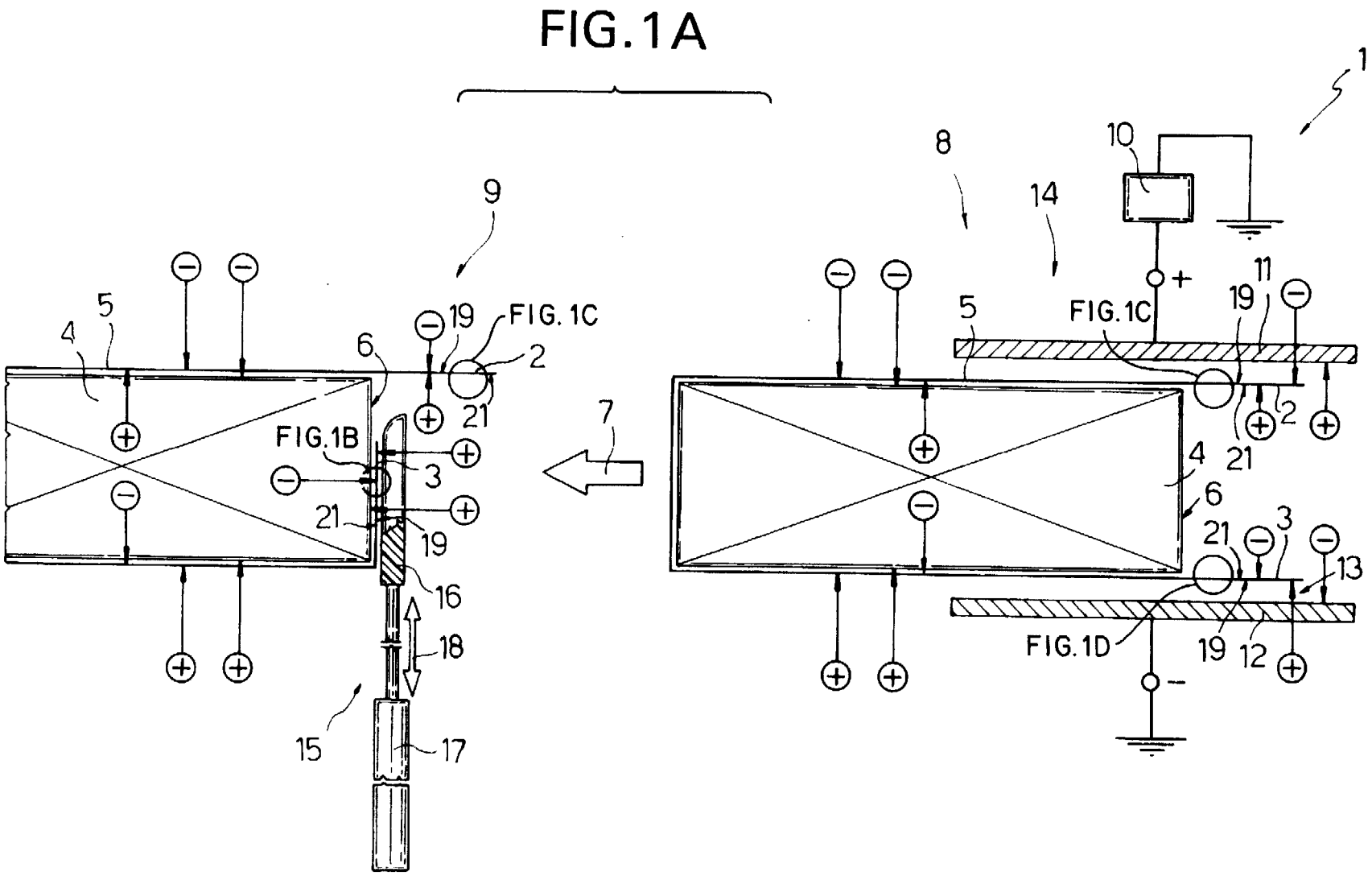
FIG. 1 shows a schematic side view, with parts in section and parts removed for clarity, of a folding unit implementing the method according to the present invention.
Figure 1B:
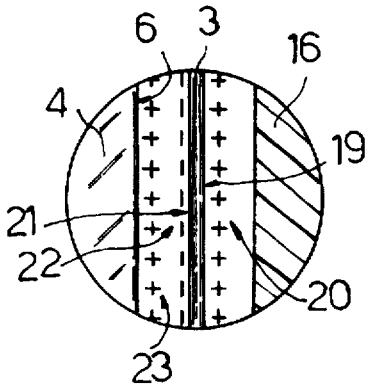
Figure 1C:
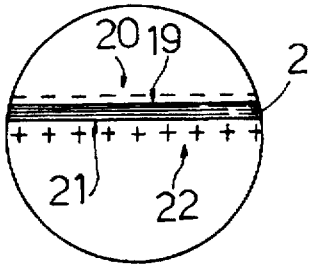
Figure 1D:
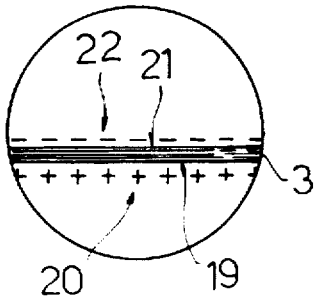

Number 1 in FIG. 1 indicates a folding unit for squarely folding at least one of two portions 2 and 3 of dielectric sheet material.

In the example shown, unit 1 forms part of an overwrapping machine, in particular a cellophaning machine, for overwrapping products 4 preferably comprising substantially parallelepiped packets made, at least externally, of dielectric material; and portions 2 and 3 constitute the end portions of a sheet 5 of dielectric overwrapping material, preferably polypropylene, which is folded about a respective product 4 to form a tubular wrapping (not shown). For which purpose, sheet 5 is first folded into a U in known manner (not shown) about respective product 4, so that end portions 2 and 3 project beyond an outer lateral surface 6 of product 4.

Product 4 and respective U-folded sheet 5 are then fed, by conveying means (not shown) and in a direction 7, through unit 1, which comprises a polarizing assembly 8 and a folding assembly 9 in series with each other in direction 7.

Polarizing assembly 8 comprises an electric source 10, and two parallel plates 11 and 12 made of electrically conductive material. Plates 11 and 12 define a passage 13 for receiving a product 4 and respective U-folded sheet 5 with portions 2 and 3 facing and parallel to each other, and parallel and adjacent to respective plates 11 and 12, and are connected electrically to respective poles of source 10 to define the plates of a capacitor 14 for generating an electric field through passage 13.

Folding assembly 9 comprises at least one folding element 15 in turn comprising a flat plate 16 preferably, but not necessarily, made of dielectric material. Plate 16 is perpendicular to direction 7, and is connected to the output of a linear actuator 17 to move, in a direction 18 perpendicular to direction 7, to and from a folding position in which plate 16 engages and squarely folds one of portions 2 and 3—in the example shown, portion 3—onto surface 6 of product 4. In the example shown, a further folding element (not shown) similar to folding element 15 obviously provides for folding portion 2 onto surface 6 and part of portion 3.

In actual use, as they travel in direction 7, product 4 and respective U-folded sheet 5 gradually enter the electric field generated by capacitor 14; on an outer surface 19 of each portion 2, 3 facing respective plate 11, 12, the electric field induces surface electric charges 20 opposite in sign to the electric charges distributed on plate 11, 12; at the same time, the electric field induces, on an inner surface 21 of each portion 2, 3, surface electric charges 22 opposite in sign to respective electric charges 20; and this charge distribution remains on sheet 5 for a given time after the sheet leaves passage 13 and proceeds with respective product 4 in direction 7 to folding assembly 9.

Upon folding assembly 9 engaging portion 2, 3, inner surface 21 is brought into contact with surface 6 of product 4, and induces, on surface 6, charges 23 opposite in sign to charges 22, and which cooperate with charges 22 to retain portion 2, 3 firmly contacting surface 6 by electrostatic attraction, even when portion 2, 3 is released by plate 16 of folding element 15.

Figures 2A, 2B:
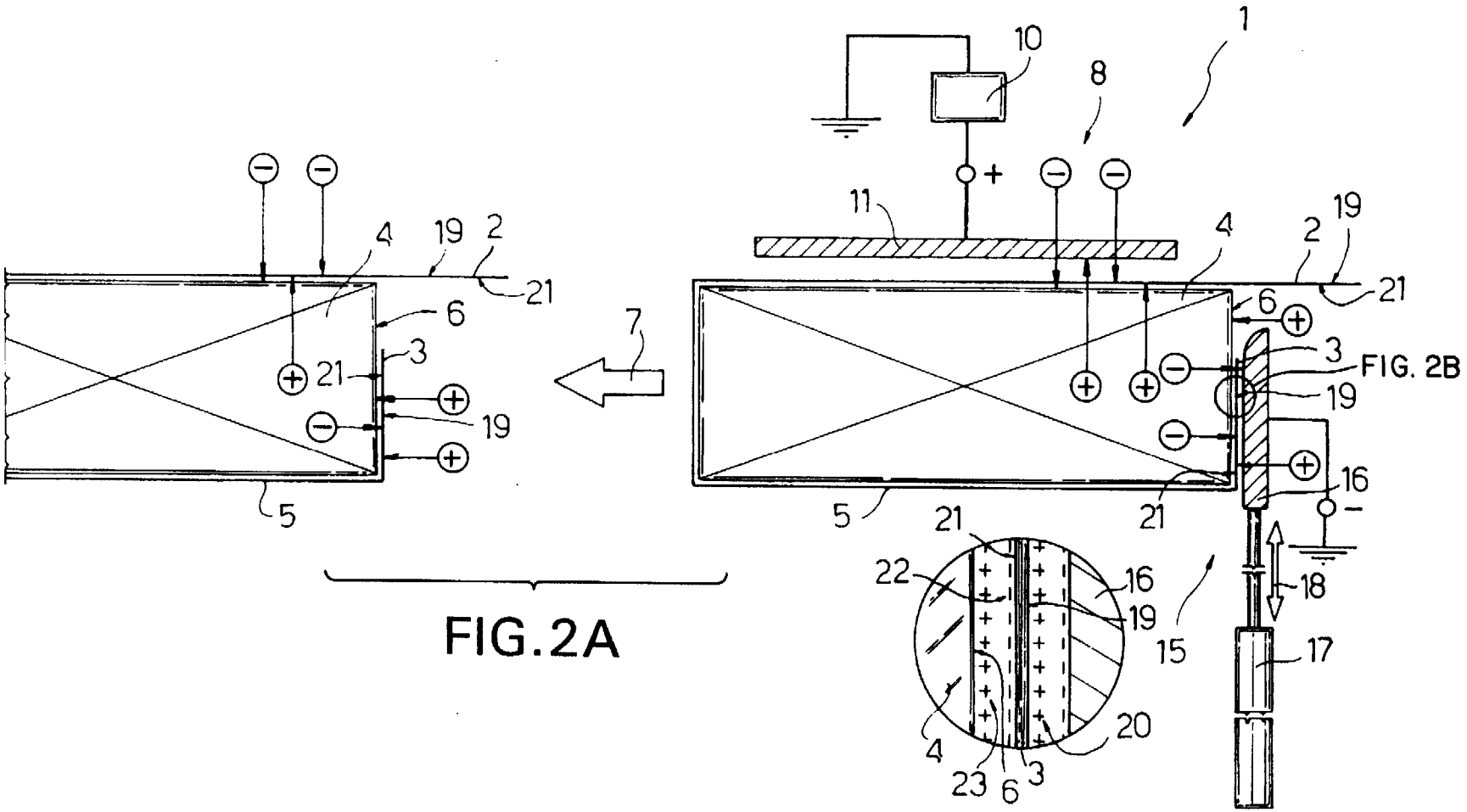
FIG. 2 shows a schematic side view, with parts in section and parts removed for clarity, of a first variation of the FIG. 1 folding unit.

In the FIG. 2 variation, plate 12 is dispensed with, and the FIG. 1 result is achieved by assembling folding element 15 at polarizing assembly 8, and connecting plate 16—in this case, made of electrically conducting material—to the pole of source 10 formerly connected to plate 12.

Figure 3B:
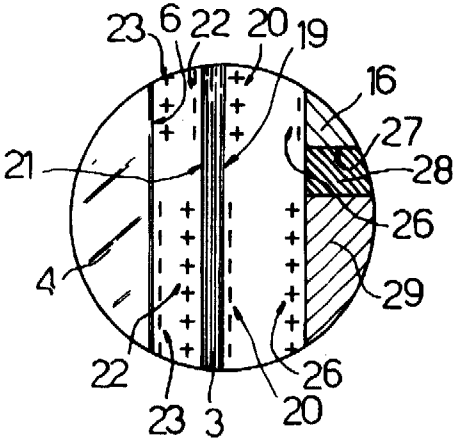
FIG. 3 shows a schematic side view, with parts in section and parts removed for clarity, of a second variation of the FIG. 1 folding unit.
Figure 3A:
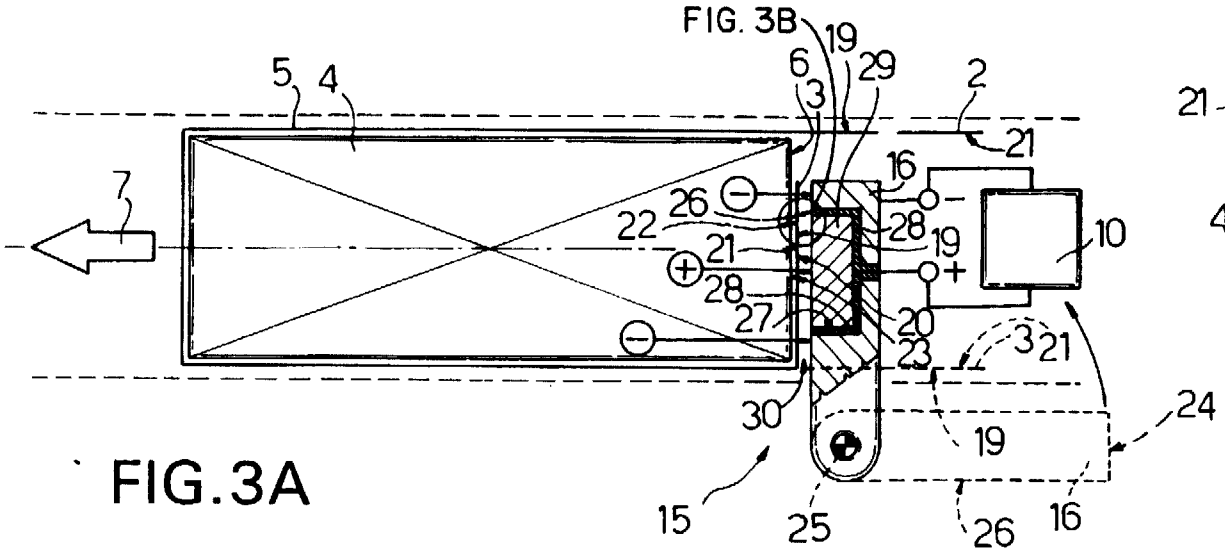

In the FIG. 3 variation, polarizing assembly 8 has no plates 11, 12, and linear actuator 17 of folding element 15 is replaced by an actuating device 24 for swinging plate 16 about an axis 25 extending along one end of plate 16, perpendicular to the traveling direction 7 of products 4, and parallel to portions 2 and 3. Plate 16 rotates about axis 25 between a first position in which plate 16 is parallel to direction 7, with a respective surface 26 facing and parallel to outer surface 19 of portion 2, 3 of sheet 5, and a second position in which plate 16 is perpendicular to direction 7, with respective surface 26 facing surface 6 of product 4. As it swings from the first to the second position, plate 16 folds portion 2, 3 squarely onto surface 6 of product 4.

Figure 4:
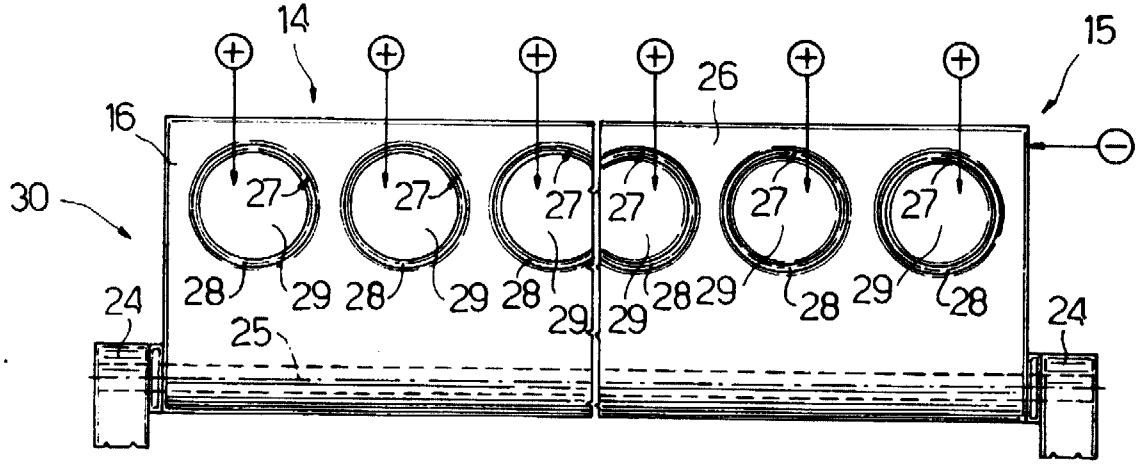
FIG. 4 shows a schematic front view, with parts removed for clarity, of a detail of the FIG. 3 folding unit.

In the FIGS. 3 and 4 variation, plate 16 is made of electrically conducting material, and comprises, on surface 26, a number of seats 27 having an inner covering 28 of electrically insulating material, and each housing a respective pad 29 made of electrically conducting material, and the outer surface of which is coplanar with surface 26.

Portion 2, 3 is polarized by connecting plate 16 to the pole of source 10 formerly connected to plate 12, and pads 29 to the pole of source 10 formerly connected to plate 11, so as to define a capacitor 30. The electric field generated by capacitor 30 induces, on the outer surface 19 of portion 2, 3 facing plate 16, surface electric charges 20 locally opposite in sign to the electric charges distributed on plate 16 and plates 29. At the same time, the electric field induces, on the inner surface 21 of portion 2, 3, surface electric charges 22 locally opposite in sign to respective electric charges 20. And, when plate 16 is positioned facing surface 6, the electric field induces, on surface 6, charges 23 locally opposite in sign to charges 22, and which cooperate with charges 22 to retain portion 2, 3 firmly contacting surface 6 by electrostatic attraction, even when portion 2, 3 is released by plate 16 of folding element 15.

In other words, in FIG. 1, portion 2, 3 is folded onto surface 6 after being polarized, whereas, in FIGS. 2 and 3, polarization and folding are performed simultaneously. In both cases, however, portion 2, 3 is retained firmly folded onto surface 6 for a given length of time, with no need for any sort of external retaining member.

I claim:

1. A method of folding portions of dielectric sheet material, the method comprising mating a sheet (5) including said portions with a product for folding the sheet about the product in a substantially U-shape configuration, wherein said portions form two outer longitudinal faced flaps; folding a first of said portions onto an outer surface of said product (4); generating an electrostatic force of attraction between said first portion and said outer surface by forming a first given distribution of electric charges on an inner surface of said first portion, and a second distribution of charges of opposite sign on said outer surface; abandoning said folded first portion; and folding a second of said portions onto said outer surface of the product and onto said folded first portion.

2. The method according to claim 1, wherein said product is made, at least externally, of dielectric material.

3. The method according to claim 1, wherein said first distribution of charges is formed by polarizing said first portion by means of an electric field prior to said step of folding the first portion; said second distribution of charges being formed by induction by said first distribution of charges as said first portion is folded.

4. The method according to claim 1, wherein both said distributions of charges are formed simultaneously by polarization by means of an electric field.

5. The method according to claim 3, wherein said electric field is formed by means of a number of plates made of electrically conducting material and located on either side of a path of the products; said plates forming the plates of a capacitor; and said folding step being performed by means of a folding element downstream from said capacitor.

6. The method according to claim 4, wherein said electric field is formed by means of a number of plates of electrically conducting material; said plates forming the plates of a capacitor; and said folding step being performed within said electric field by means of a folding element forming one of the plates of the capacitor generating said electric field.

7. The method according to claim 4, wherein said electric field is formed by a folding element; said folding element performing said folding step.

8. The method according to claim 7, wherein said folding element comprises a number of substantially coplanar plates electrically insulated with respect to one another, and forming the plates of a capacitor generating said electric field.

* * * * *